United States Patent [19]

Spadafora

[11] Patent Number: 4,696,115

[45] Date of Patent: Sep. 29, 1987

[54] METHOD AND APPARATUS FOR DRYING WET PARTICULATE MATERIAL TO A PREDETERMINED UNIFORM MOISTURE CONTENT

[75] Inventor: Paul F. Spadafora, Lagrangeville, N.Y.

[73] Assignee: Nabisco Brands, Inc., Parsippany, N.J.

[21] Appl. No.: 887,328

[22] Filed: Jul. 22, 1986

[51] Int. Cl.[4] ..... F26B 3/06

[52] U.S. Cl. ..... 34/43; 34/48; 34/50; 34/54

[58] Field of Search ..... 34/46, 48, 54, 43, 31, 34/34, 135, 136, 137, 141

[56] References Cited

U.S. PATENT DOCUMENTS

| | | | |
|---|---|---|---|
| 2,822,153 | 2/1958 | Arnold . | |
| 3,204,341 | 9/1965 | Whitsel, Jr. . | |
| 3,259,995 | 7/1966 | Powischill . | |
| 3,350,790 | 11/1967 | Whitsel, Jr. | 34/48 |
| 3,367,038 | 2/1968 | Bishop, Sr. . | |
| 3,400,468 | 9/1968 | Matthews . | |
| 3,600,820 | 8/1971 | Klein . | |
| 3,905,123 | 9/1975 | Fowler et al. | 34/46 |
| 4,004,351 | 1/1977 | Sanneman et al. . | |
| 4,204,337 | 5/1980 | Roos et al. . | |
| 4,241,515 | 12/1980 | Wochnowski et al. . | |
| 4,492,040 | 1/1985 | Jensen et al. . | |
| 4,501,072 | 2/1985 | Jacobi, Jr. et al. . | |
| 4,531,306 | 7/1985 | Erickson . | |

*Primary Examiner*—Larry I. Schwartz
*Attorney, Agent, or Firm*—Richard Kornutik

[57] ABSTRACT

In a fluidized bed drying process, the average temperature of a group of particles being dried rises during a warm-up zone, remains constant during a constant-temperature drying zone and again increases during a final zone. In order to maintain the moisture content of the product at the output of the oven at a substantially constant level despite variations in the moisture content at the inlet to the oven, the temperature and/or flow rate of the drying air to the oven is varied in accordance with measured differences in the temperature of the group of particles at two instants in time during the drying process. At least one of the instants occurs during the warming-up zone or during the final temperature-increasing zone.

22 Claims, 3 Drawing Figures

METHOD AND APPARATUS FOR DRYING WET PARTICULATE MATERIAL TO A PREDETERMINED UNIFORM MOISTURE CONTENT

BACKGROUND OF THE INVENTION

This invention relates to a method and apparatus for drying wet particulate material. More particularly, the method and apparatus of this invention are directed to controlling the drying of particles in a bed in a drying oven so that the moisture content of the particles at the oven's product outlet is substantially constant, despite variations in the moisture of the particles as they enter or are placed in the oven.

In the manufacture of particulate solids such as cereal products, the wet particulate material is dried in an oven. It is desirable that the product at the oven's outlet has a uniform moisture content. Such a uniform moisture content is difficult to achieve when the particulate material varies in composition, particularly in moisture content, from day to day and even from hour to hour, as is the case in the food industry.

Many proposals have been made for varying one or more control parameters of the drying process in response to detected changes in a monitored parameter. In many cases, the mass flow of the particulate material or the temperature of the drying air is varied in accordance with deviations in the moisture content of the product at the output of the drying oven. In other cases, the drop in the temperature of the drying air upon passing through a bed of the particulate material is measured and used to control the drying process.

U.S. Pat. No. 3,367,038 to Bishop, Sr., discloses a system for drying rubber in which the monitored variable is a temperature differential between the temperature of the drying air at a preselected location and the temperature of the rubber in the vicinity of that location.

U.S. Pat. No. 3,259,995 to Powischill teaches a method and apparatus for drying fibers, chemicals and other materials, in which method and apparatus moisture content control is accomplished by continuously sensing the temperature of a drying medium upon passage of that medium through the material being dried, the sensing being relative to a predetermined theoretical temperature at the scanning point. The drying conditions and/or drying rate is then automatically varied in response to deviations in the temperature drop of the drying medium relative to a predetermined temperature drop at the scanning point.

As disclosed in U.S. Pat. No. 3,204,361 to Whitsel, Jr., the drying of wet particulate material as it travels through a drier includes a first phase in which the surface temperature of the particles rises, a second phase in which the surface temperature of the particles remains at a substantially constant value, and a third phase in which the particles again increase in surface temperature towards the temperature of the drier itself. Whitsel, Jr., is directed in particular to varying the heat input to the drier in response to movements of a temperature breaking point towards the inlet or outlet of the drier. The temperature breaking point is that point where the second drying phase ends and the third drying phase begins. Specifically Whitsel, Jr., discloses an apparatus having a series of thermocouples placed in a linear array about the location of the ideal temperature breaking point in the dryer. The thermocouples are connected in series to one another, the temperature of the drying medium being increased or decreased respectively in accordance with a decrease or increase in the total E.M.F. of the thermocouples.

An object of the present invention is to provide an improved method and apparatus for drying particulate material to obtain a uniform moisture content thereof despite variations in the moisture content of the particulate material at the onset of the drying operation.

Another, more particular, object of the present invention is to provide such a method and apparatus in which the production rate is held at a substantially constant level.

SUMMARY OF THE INVENTION

The present invention is directed in part to a method for drying wet particulate material in a particle bed in a drying oven, wherein the particles have an average surface temperature rising during a first drying phase, remaining substantially constant during a second drying phase and again rising during a third drying phase. The method in accordance with the invention comprises the automatically performed steps of supplying drying air to the oven, measuring a first average temperature of a group of wet particles in the oven at a first instant during a drying operation, and measuring a second average temperature of the group of particles at a second instant subsequent to the first instant during the drying operation. At least one of the first and second instants occurs during either the first or the third drying phase. In subsequent steps, a difference is calculated between the measured average temperatures, the difference is compared with a predetermined value, and a parameter of the drying operation is modified in response to a detected deviation between the calculated difference and the predetermined value.

Preferably, if the temperature of the group of particles is measured at only two points in time, the measurement at the first instant occurs during the second drying phase and the measurement at the second instant occurs during the third drying phase. Advantageously, the measurement during the third drying phase occurs near the beginning of that phase.

In accordance with the invention, the drying operation can either be a batch drying process or a continuous drying process. If the process takes place in batches, the steps of temperature measurement are performed at the same location in the drying oven. In the case that the drying operation is a continuous process, the bed of wet particles is continuously conveyed through the oven, the measurement steps being performed at different locations within the oven. The bed of particles can be either a fixed bed or a fluidized bed.

Pursuant to further particular features of the present invention, the parameter modified is an average absolute temperature of the particles in the oven, the drying operation being terminated upon the lapse of a preestablished period of time. The average absolute temperature of the particles is advantageously varied by changing the temperature of the drying air fed to the oven or by changing the flow rate of the drying air.

In a preferred embodiment of the present invention, the temperature of the group of particles is measured at six different points in time (six different locations in the case of a continuously translating fluidized bed). The first and second measurements occur during the first drying phase, a third average temperature being measured at a third instant occurring during the second drying phase. A fourth and a fifth average temperature of the particles are sensed during the third drying phase, a sixth temperature being measured during a fourth drying phase wherein the average surface temperature of the particles again has a substantially constant value. In addition to the difference between the first and second average temperature, temperature differentials are calculated between the second and third average temperature, between the third and the fourth average temperature, between the fourth and the fifth average temperature, and between the fifth and the sixth average temperature. Each of the calculated temperature differentials is compared with a respective predetermined value and a parameter of the drying operation is modified in response to a detected deviation between any of the calculated temperature differentials and the respective predetermined value.

In the case that the drying operation comprises a continuous process, the oven preferably has a first chamber at an inlet and a second chamber at an outlet, the second drying phase occuring in the first chamber and the fourth drying phase occuring in the second chamber. A first stream of drying air is fed to the first chamber, while a second stream of drying air is fed to the second chamber, a parameter of the first stream being modified in response to a detected difference between the third and fourth average temperature and a parameter of the second stream being modified in response to a detected difference between the fifth and the sixth average temperature.

The present invention is also directed to an apparatus comprising a drying oven, feed means for supplying drying air to the oven, a support in the oven for holding the wet particles in a fixed or fluidized bed, and one or more sensors disposed in the oven for measuring a first and a second average temperature of the group of wet particles. The two average temperatures are measured at different times, at least one of the measurements occurring during a rising temperature drying phase. A computing unit is operatively connected to the sensor or sensors for calculating the difference between the first and the second average temperature in response to signals received from the sensor or sensors and for comparing the calculated difference with a predetermined value. Control means are operatively connected to the computing unit for modifying a parameter of the drying operation in response to a detected deviation between the calculated difference and the predetermined value.

As heretofore described, the oven may include at least a first and a second chamber, means being provided for feeding a first stream of drying air to the first chamber and a second stream of drying air to the second chamber. The control means modifies the air temperatures and/or the air flow rates of the first and/or the second stream in response to a calculated difference between the first and the second average temperature.

A particular advantage of a method and apparatus in accordance with the present invention is that, if a change in the composition of a series of batches of a wet product or in a continuous stream of the product being dried takes place in a short period of time, the system compensates for shifts in the product temperature-moisture equilibrium as well as drier loading. For example, if a cereal product is being dried and the protein of the product suddenly increases, the moisture of the product will also increase inasmuch as the higher protein product tends to retain a greater amount of moisture than a lower protein product. Such a sudden increase in moisture content is quickly detected and compensated by the method and apparatus of the present invention. In contrast, in a system in which drying parameters are modified in response to detected changes in the temperature breaking point, a product having an undesired moisture content will be produced until a new temperature breaking point is established.

A system in accordance with the present invention compensates for product temperature-moisture equilibrium variations due to composition or other factors not by setting a specific temperature but by using temperature differences. Although the equilibrium shifts and the absolute temperature of the product changes, the shape of the temperature curve remains constant and relative temperature differences along the curve remain the same.

DETAILED DESCRIPTION

Figure 1:
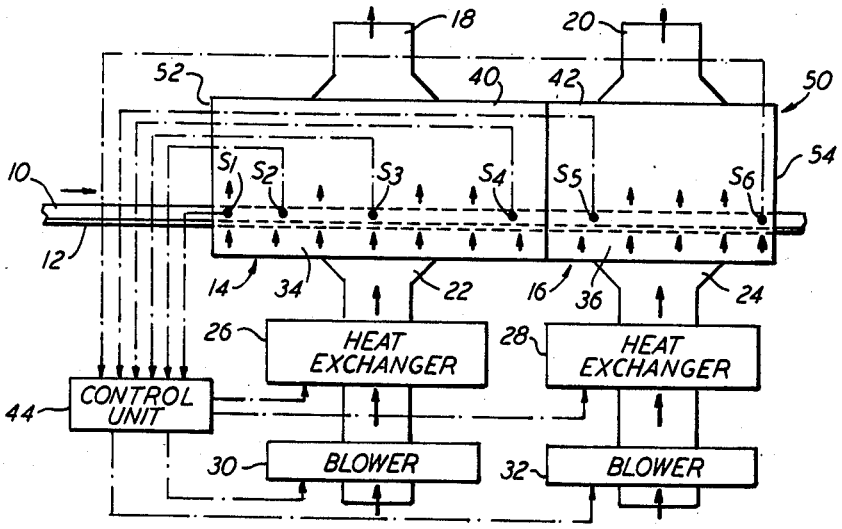
FIG. 1 is a schematic diagram of an apparatus in accordance with the present invention, for drying wet particulate material.

An apparatus for drying wet particulate material such as cereal particles or cookies comprises, as illustrated in FIG. 1, a vibrating inclined support web 12 carrying a bed 10 of fluidized particles. The web 12 enters a first chamber 14 of a drying oven 50 through an inlet opening in a side panel 52 of the oven. Web 12 then traverses a second chamber 16 of drying oven 50 and leaves that chamber through an exit opening in another side panel 54 of the oven.

Each oven chamber 14 and 16 has a respective air outlet port 18 and 20 and a respective air inlet port 22 and 24, the inlet ports being connected by conduits to respective heat exchangers 26 and 28 and respective blowers 30 and 32. The blowers serve to pressurize lower chamber portions 34 and 36 of oven chambers 14 and 16 with air heated by heat exchangers 26 and 28. The pressurized air flows through apertures 38 (See FIG. 3) in vibrating belt 12 and through interstitial spaces in the bed of particles to upper chamber portions 40 and 42 of chambers 14 and 16. The air in upper chamber portions 40 and 42 exits through the oven outlet ports 18 and 20.

Six stationary temperature sensors $S_1$–$S_6$ are disposed in oven chambers 14 and 16 within the traveling bed of fluidized particles. The sensors have respective output leads extending to a control unit 44 such as a microprocessor. The control unit in turn has output leads working into heat exchangers 26 and 28 and blowers 30 and 32 for controlling the operation thereof. It is to be noted that temperature measurement may be accomplished alternatively by non-contact devices such as infrared detectors or by calculation from such monitored parameters as cookie color or drying air temperature.

Figure 2:
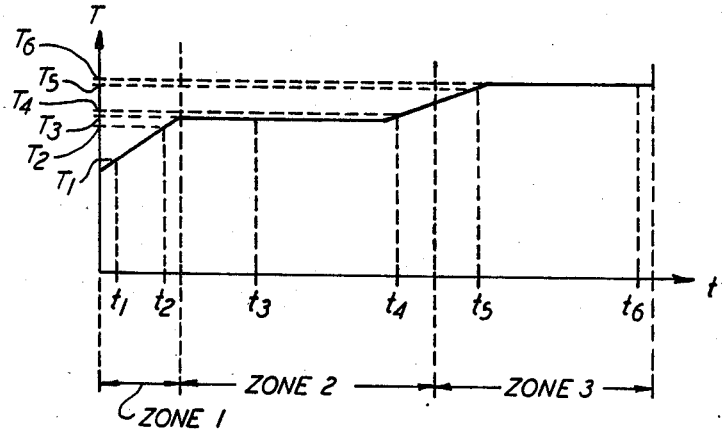
FIG. 2 is a graph of an average surface temperature of a group of particles being dried in the apparatus of FIG. 1, as a function of time.

FIG. 2 is a graph of the temperature of a representative group of a fluidized particles as a function of the time the group of particles is in the drying oven 50. Inasmuch as the bed of fluidized particles is presumed to move at a constant rate through drying oven 50, the abscissa of any point on the graph of FIG. 2 corresponds to a travel distance of the selected group of fluidized particles through oven chambers 14 and 16.

The drying of the particles can be divided into three zones, namely, a warming-up zone (zone 1), a constant-temperature drying zone (zone 2) and a final temperature-stabilizing zone (zone 3). Zones 1 and 2 correspond to the first oven chamber 14, while zone 3 takes place in oven chamber 16. For particulate material which is particularly moisture laden, a third oven (not illustrated) is advantageously provided for the warming-up zone.

The mass flow rate of the bed of fluidized particles, determined in part by the depth of the bed and the rate of travel, and initial or reference values of the air flow rates and temperatures are chosen by empirical studies so that a plateau temperature $T_3$ in the second drying zone corresponds to a maximum product throughput rate of the drying apparatus. This plateau temperature $T_3$ is subject to the limitation of being substantially below the maximum permissible temperature of the particles, e.g., well below the temperature at which the particles being to oxidize.

Control unit 44 periodically samples the output signals of sensors $S_1$–$S_6$ to determine, for each of a series of different portions of fluidized bed 10, the temperatures $T_1$–$T_6$ of the group of particles at six respective instants $t_1$–$t_6$ in time. A given group of particles, i.e., a portion of bed 10, enters the oven and is located in the vicinity of sensor $S_1$ at instant $t_1$. This instant is a point in time near the start of the drying process and is used as a starting reference point. At subsequent instant $t_2$, the average temperature of the selected group of particles is measured by sensor $S_2$. This temperature $T_2$ depends on the heating capacity of the drier 50, and, in particular, of chamber 14, and further depends on the mass and moisture content of the fluidized bed of particles. Instant $t_2$ is preferably a point in time near the end of the warming-up zone and prior to the constant-temperature drying zone.

Sensor $S_3$ detects the temperature $T_3$ of the selected group of particles at instant $t_3$ within the constant-temperature drying zone. At instant $t_4$, control unit 44 samples the output signal of sensor $S_4$, this instant $t_4$ being at a point in time at the beginning of a falling rate zone during which the rate at which water evaporates from the particles decreases.

As illustrated in FIG. 2, a second constant-temperature drying zone (between instants $t_5$ and $t_6$) may occur in oven chamber 16 at the end of a drying process. Two final temperature measurements are made at instants $t_5$ and $t_6$, the last measurement taking place within the second constant-temperature zone and the penultimate measurement taking place immediately prior to that constant-temperature drying zone.

In accordance with the invention, control of the drying is advantageously achieved by holding the total drying time constant and by varying the absolute product temperature in response to deviations, from predetermined reference values, of differences between successive temperature measurements for any given group of particles traveling through drying oven 50. Accordingly, upon sampling the output signal of sensor $S_2$ at instant $t_2$, control unit forms the difference between the temperature represented by that output signal and the temperature measured by sensor $S_1$ at instant $t_1$ for the same group of particles. Control unit 44 compares this temperature difference with a predetermined value and modifies the operation of heat exchanger 26 and/or blower 30 if the calculated temperature difference differs from the predetermined value by more than a pre-established threshold. More specifically, if the difference between the temperatures measured by sensors $S_2$ and $S_1$ falls below a pre-established value, exemplarily owing to an increase in the mass or moisture content of the fluidized bed 10, control unit 44 increases the heat input to oven chamber 14 by controlling heat exchanger 26 to increase the drying air temperature, by controlling blower 30 to increase the volume of drying air entering the oven chamber or, alternatively, by decreasing the feed rate (slowing the motion of fluidized bed 10).

The effects of variations of the mass flow rate of fluidized bed 10 on a difference calculated by control unit between temperatures $T_4$ and $T_3$ are qualitatively the same as the effects of such changes in mass flow rate on the difference in temperatures $T_2$ and $T_1$. Accordingly, the action taken by control unit 44 upon detecting a deviation, from a pre-established value, of temperature difference $T_4-T_3$ is similar to the action taken by the control unit in response to deviations of difference $T_2-T_1$ from a predetermined value. Maintaining temperature difference $T_4-T_3$ at approximately a constant value is crucial inasmuch as this temperature difference corresponds to the end of the constant drying rate where the bulk of the moisture content of the particulate material is removed for most products. If the temperature difference $T_4-T_3$ is kept relatively constant, the final moisture content can be controlled with greater precision.

Control unit 44 preferably controls heat exchanger 26 and/or blower 30 to vary the drying effect of the stream of air entering lower chamber portion 34 via air inlet 22. Control is effectuated in response to comparisons made between temperature differences $T_2-T_1$, $T_3-T_2$ and $T_4-T_3$ and predetermined reference values. Similarly, heat exchanger 28 and blower 32 are operated by control unit 44 to vary the heat input to chamber portion 36 in response to deviations of temperature differences $T_5-T_4$ and $T_6-T_5$ from predetermined reference values. By way of further example, if temperature difference $T_6-T_5$ rises above a preset value, heat exchanger 28 or blower 32 is controlled by unit 44 to lower the temperature of flow rate of the air flowing into lower chamber portion 36.

The response of control unit 44 to temperature difference $T_2-T_1$ is a form of feed-forward control, while the response of the control unit to temperature difference $T_4-T_3$ is a form of feedback control.

In accordance with the invention, the general shape of the temperature versus time profile is established for a specific class of product. To maintain a constant moisture content in the product at the output of the drying oven, no specific temperature breaking point is established. Instead, a difference between temperatures of the product a various points in time are measured, calculated and compared with predetermined reference values. For best control of the entire drying process, the six points described with reference to FIGS. 1 and 2 should be used. If only two temperature measurements are made, these measurements should be made at instants $T_4$ and $T_3$.

Figure 3:
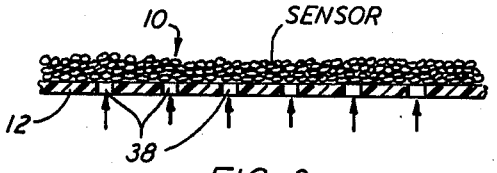
FIG. 3 is a cross-sectional view of a fluidized bed of particles in the drying oven of FIG. 1.

In a drying apparatus in accordance with the invention, product temperature can be determined by direct measurement, as illustrated in FIGS. 1 and 3, or by non-contact methods such as infrared detectors or other radiation measurements and can also be calculated using mathematical models and algorithms based on other parameters such as color or drying medium measurements.

Inasmuch as the present invention is applicable to ovens and roasters as well as driers, the term "drying oven" used herein is deemed to include all those kinds of apparatus. Moreover, although the instant invention is non-specific with respect to the product being dried, the invention would be most suitable in the cases of natural product and heat-sensitive products which must maintain relatively more precise temperature-moisture profiles.

Although the invention has been described in terms of particular embodiments and applications, one of ordinary skilled in the art, in light of this teaching, can generate additional embodiments and modifications without departing from the spirit of or exceeding the scope of the claimed invention. For example, the invention has been described in terms of a continuous feed system utilizing a fluidized bed, however, the principles of the invention apply as well to a batch system utilizing a fluidized or a fixed bed. In the latter case, there need be but one sensor, the graph of FIG. 2 showing the temperature measured by that sensor as a function of time alone and not as a function of travel distance through the drying oven. Accordingly, it is to be understood that the drawings and descriptions herein are proffered by way of example to facilitate comprehension of the invention and should not be construed to limit the scope thereof.

What is claimed is:

1. A method for the drying of wet particles in a particle bed in a drying oven, said particles having an average surface temperature rising during a first drying phase, remaining substantially constant during a second drying phase and again rising during a third drying phase, said method comprising the automatically performed steps of:

supplying drying air to the oven;

measuring a first average temperature of a group of wet particles in said oven at a first instant during a drying operation;

measuring a second average temperature of said group of wet particles at a second instant subsequent to said first instant during said drying operation, said first and said second instant occurring during the first drying phase;

measuring a third average temperature of said group of wet particles at a third instant subsequent to said second instant, said third instant occurring during said second drying phase;

measuring a fourth average temperature of said group of wet particles at a fourth instant subsequent to said third instant, said fourth instant occurring during said third drying phase;

calculating a difference between said first and said second average temperature;

calculating a difference between said third and said fourth average temperature;

comparing each of the calculated differences with a respective predetermined value; and modifying a parameter of the drying operation in response to a detected deviation between either of the calculated differences and the respective predetermined value, whereby at a termination of said drying operation the moisture content of a dried product is substantially uniform despite variations in moisture content of the product at a beginning of said drying operation.

2. The method defined in claim 1, further comprising the automatically performed steps of:

measuring a fifth average temperature of said group of wet particles at a fifth instant subsequent to said fourth instant, said fifth instant occurring during said third drying phase;

measuring a sixth average temperature of said group of wet particles at a sixth instant subsequent to said sixth instant, said sixth instant occurring during a fourth drying phase wherein the average surface temperature of the particles again has a substantially constant value;

calculating a first additional difference between said second and said third average temperature;

calculating a second additional difference between said fourth and said fifth average temperature;

calculating a third additional difference between said fifth and said sixth average temperature;

comparing each of the calculated additional differences with a respective predetermined value; and modifying a parameter of the drying operation in response to a detected deviation between any of the calculated additional differences and the respective predetermined value.

3. The method defined in claim 2 wherein said drying operation comprises a continuous process in which the particles being dried are fed to the oven through an inlet thereof and leave said oven through an outlet thereof, said oven having a first chamber at said inlet and a second chamber at said outlet, said second drying phase occurring in said first chamber and said fourth drying phase occurring in said second chamber.

4. The method defined in claim 1 wherein said fourth instant occurs near the beginning of said third drying phase.

5. The method defined in claim 1 wherein said drying operation essentially consists of a batch drying process, said steps of measuring being performed at the same location in said oven.

6. The method defined in claim 1 wherein said drying operation essentially consists of a continuous drying process, further comprising the step of continuously conveying a fluidized bed of wet particles through said oven, said steps of measuring being performed at different locations in said oven.

7. The method defined in claim 1 wherein said step of modifying a parameter includes the step of varying an average absolute temperature of said group of wet particles in said oven, said drying operation being terminated upon the lapse of a pre-established period of time.

8. The method defined in claim 7 wherein said step of varying said average absolute temperature comprises the step of changing the flow rate of drying air fed to said oven.

9. The method defined in claim 7 wherein said step of varying said average absolute temperature comprises the step of changing the temperature of drying air fed to said oven.

10. An apparatus for the drying of wet particles having during a drying operation an average surface temperature rising during a first drying phase, remaining substantially constant during a second drying phase and again rising during a third drying phase, said apparatus comprising:

an oven;

feed means for supplying drying air to said oven;

holding means in said oven for supporting the wet particles in a bed in said oven;

sensor means disposed in said oven for measuring a first average temperature of a group of wet particles in said oven at a first instant during the first drying phase, for measuring a second average temperature of said group of wet particles at a second instant subsequent to said first instant during said first drying phase, for measuring a third average temperature of said group of wet particles during the second drying phase, and for measuring a fourth average temperature of said group of wet particles during the third drying phase;

computing means operatively connected to said sensor means for calculating, in response to signals from said sensor means, a difference between said first and said second average temperature and a difference between said third and said fourth average temperature and for comparing the differences with respective predetermined values; and control means operatively connected to said computing means for modifying a parameter of the drying operation in response to a detected deviation between either of the calculated differences and the respective predetermined value, whereby at a termination of said drying operation the moisture content of a dried product is substantially uniform despite variations in moisture content of the product at a beginning of said drying operation.

11. The apparatus defined in claim 10 wherein said oven has an inlet and an outlet and wherein said holding means comprises an elongate surface extending into said oven through said inlet and out of said oven through said outlet, said holding means further comprising means for continuously feeding the particles through said oven, said sensor means comprising a plurality of sensors disposed at respective locations longitudinally spaced from one another with respect to said elongate surface.

12. The apparatus defined in claim 11 wherein said oven has a first chamber at said inlet and a second chamber at said outlet, said second drying phase occurring in said first chamber and a fourth drying phase occurring in said second chamber, said group of wet particles having a substantially contant average temperature during said fourth drying phase.

13. The apparatus defined in claim 10 wherein said drying operation essentially consists of a batch drying process, said sensor means comprising a single sensor operating to measure the temperature of said group of wet particles at said first and said second instant and during said third and said fourth drying phase.

14. A method for the drying of wet particles in a particle bed in a drying oven, said particles having an average surface temperature rising during a first drying phase, remaining substantially constant during a second drying phase and again rising during a third drying phase, said method comprising the automatically performed steps of:

supplying drying air to the oven;

measuring a first average temperature of a group of wet particles in said oven at a first instant during a drying operation;

measuring a second average temperature of said group of wet particles at a second instant subsequent to said first instant during said drying operation, said first and said second instant occurring during the first drying phase;

measuring a third average temperature of said group of wet particles at a third instant subsequent to said second instant, said third instant occurring during said second drying phase;

measuring a fourth average temperature of said group of wet particles at a fourth instant subsequent to said third instant, said fourth instant occurring during said third drying phase;

measuring a fifth average temperature of said group of wet particles at a fifth instant subsequent to said fourth instant, said fifth instant occurring during said third drying phase;

measuring a sixth average temperature of said group of wet particles at a sixth instant subsequent to said sixth instant, said sixth instant occurring during a fourth drying phase wherein the average surface temperature of the particles again has a substantially constant value;

calculating a difference between said first and said second average temperature;

calculating a difference between said second and said third average temperature;

calculating a difference between said third and said fourth average temperature;

calculating a difference between said fourth and said fifth average temperature;

calculating a difference between said fifth and said sixth average temperature;

comparing each of the calculated differences with a respective predetermined value; and modifying a parameter of the drying operation in response to a detected deviation between any of the calculated differences and the respective predetermined value, whereby at a termination of said drying operation the moisture content of a dried product is substantially uniform despite variations in moisture content of the product at a beginning of said drying operation, said drying operation comprising a continuous process in which the particles being dried are fed to the oven through an inlet thereof and leave said oven through an outlet thereof, said oven having a first chamber at said inlet and a second chamber at said outlet, said second drying phase occurring in said first chamber and said fourth drying phase occurring in said second chamber, said step of feeding drying air to said oven comprising the steps of feeding a first stream of drying air to said first chamber and feeding a second stream of drying air to said second chamber, a parameter of said first stream being modified in response to a detected difference between said third and said fourth average temperature and a parameter of said second stream being modified in response to a detected difference between said fifth and said sixth average temperature.

15. The method defined in claim 14 wherein the parameters modified in response to detected differences between average temperatures include the temperatures of said first stream and said second stream.

16. The method defined in claim 14 wherein the parameters modified in response to detected differences between average temperatures include the flow rates of said first stream and said second stream.

17. An apparatus for the drying of wet particles having during a drying operation an average surface temperature rising during a first drying phase, remaining substantially constant during a second drying phase and again rising during a third drying phase, said apparatus comprising:

an oven;

feed means for supplying drying air to said oven;

holding means in said oven for supporting the wet particles in a bed in said oven, said oven having an inlet and an outlet and said holding means comprising an elongate surface extending into said oven through said inlet and out of said oven through said outlet, said holding means further comprising means for continuously feeding the particles through said oven, said oven having a first chamber at said inlet and a second chamber at said outlet, said second drying phase occurring in said first chamber and a fourth drying phase occurring in said second chamber, said group of wet particles having a substantially constant average temperature during said fourth drying phase, said feed means comprising first means for feeding a first stream of drying air to said first chamber and second means for feeding a separate second stream of drying air to said second chamber;

sensor means disposed in said oven for measuring a first average temperature of a group of wet particles in said oven at a first instant during the drying operation and for measuring a second average temperature of said group of wet particles at a second instant subsequent to said first instant during said drying operation, at least one of said first and said second instant occurring during one of the first and the third drying phase, said sensor means comprising a plurality of sensors disposed at respective locations longitudinally spaced from one another with respect to said elongate surface;

computing means operatively connected to said sensor means for calculating a difference between said first and said second average temperature in response to signals received from said sensor means and for comparing said difference with a predetermined value; and control means operatively connected to said computing means for modifying a parameter of the drying operation in response to a detected deviation between said difference and said predetermined value, said control means being operatively connected to said first means for modifying a parameter of said first stream in response to a detected difference between said first and said second average temperature, said control means being operatively connected to said second means for modifying a parameter of said second stream in response to a detected difference between a third and fourth average temperature of said group of wet particles, said third and said fourth average temperature being measured by said sensor means at instants subsequent to said second instant and during said third drying phase and said fourth drying phase, respectively, whereby at a termination of said drying operation the moisture content of a dried product is substantially uniform despite variations in moisture content of the product at the beginning of said drying operation.

18. The apparatus defined in claim 17 wherein the parameters of said first and said second stream modified by said control means include air temperatures of said first and said second stream.

19. The apparatus defined in claim 17 wherein the parameters of said first and said second stream modified by said control means include air flow rates of said first and said second stream.

20. An apparatus for the drying of wet particles having during a drying operation an average surface temperature rising during a first drying phase, remaining substantially constant during a second drying phase and again rising during a third drying phase, said apparatus comprising:

an oven;

feed means for supplying drying air to said oven;

holding means in said oven for supporting the wet particles in a bed in aid oven;

sensor means disposed in said oven for measuring a first average temperature of a group of wet particles in said oven at a first instant during the drying operation and for measuring a second average temperature of said group of wet particles at a second instant subsequent to said first instant during said drying operation, at least one of said first and said second instant occurring during one of the first and the third drying phase;

computing means operatively connected to said sensor means for calculating a difference between said first and said second average temperature in response to signals received from said sensor means and for comparing said difference with a predetermined value; and control means operatively connected to said computing means for modifying a parameter of the drying operation in response to a detected deviation between said difference and said predetermined value, whereby at a termination of said drying operation the moisture content of a dried product is substantially uniform despite variations in moisture control of the product at the beginning of said drying operation, said control means including timing means for terminating said drying operation upon the lapse of a pre-established period of time and temperature modification means for varing an average absolute temperature of said group of wet particles in said oven.

21. The apparatus defined in claim 20 wherein said temperature modification means includes means for changing the flow rate of drying air fed to said oven.

22. The apparatus defined in claim 20 wherein said temperature modification means includes means for changing the temperature of drying air fed to said oven.

* * * * *